US005476023A

United States Patent [19]

Calandro

[11] Patent Number: 5,476,023

[45] Date of Patent: Dec. 19, 1995

[54] LID REMOVING DEVICES

[76] Inventor: Stephen P. Calandro, 6180 Esplanade Ave., Baton Rouge, La. 70806

[21] Appl. No.: 248,103

[22] Filed: May 24, 1994

[51] Int. Cl.[6] ..... B67B 7/16

[52] U.S. Cl. ..... 81/3.57; 81/3.36

[58] Field of Search ..... 81/3.09, 3.36, 81/3.55, 3.57; 254/113, 120, 119; 7/151; 294/15–18; D8/18, 33, 40, 43, 88

[56] References Cited

U.S. PATENT DOCUMENTS

| | | | |
|---|---|---|---|
| D. 254,834 | 4/1980 | Madsen et al. | D8/18 |
| 2,049,489 | 8/1936 | Christen | 81/3.57 X |
| 2,662,728 | 12/1953 | Hanes et al. | 254/119 |
| 2,729,990 | 1/1956 | Ballman | 254/113 |

FOREIGN PATENT DOCUMENTS

| | | | |
|---|---|---|---|
| 2161796 | 1/1986 | United Kingdom | 81/3.57 |

*Primary Examiner*—D. S. Meislin

[57] ABSTRACT

A lid removing device comprises a clamp consisting of a front leg, a rear leg and a central segment therebetween. A vertically positioned front leg is formed as a solid generally rectangular shaped block. A rear leg is formed as a solid generally rectangular shaped block. The lowermost extent of the rear leg includes a frontwardly extending horizontal member with a slanted end. A horizontally positioned central segment is formed as a solid generally rectangular shaped block. The central segment is positioned upon the uppermost extents of the front and rear segments. A handle is formed as a solid generally rectangular shaped block with an upper region and a lower region. The lower region is formed as a solid-generally rectangular shaped block with an angled end at its lowermost extent. The lowermost extent is affixed to the central segment in an angled orientation in a direction opposite from the legs. The upper region is formed as a solid generally rectangular shaped block and includes a plurality of concave grooves.

3 Claims, 4 Drawing Sheets

LID REMOVING DEVICES

BACKGROUND OF THE INVENTION

1. Field of the Invention

The present invention relates to lid removing devices and more particularly pertains to removing lids from containers by positioning the apparatus on the lid and forcing the handle forward utilizing the user's body weight.

2. Description of the Prior Art

The use of lid and can openers is known in the prior art. More specifically, lid and can openers heretofore devised and utilized for the purpose of opening cans and removing lids from containers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,082,016 to Vonusa a lid remover.

U.S. Pat. No. 4,633,740 to Jacobs discloses a combination receptacle opener.

U.S. Pat. No. 4,889,018 to Shaffer discloses a lid remover.

U.S. Pat. No. 4,967,436 to Russell discloses a combination lid removal tool.

Lastly, U.S. Pat. No. 5,189,750 to Brennan discloses a combination bottle opener and can opener.

In this respect, the lid removing devices according to the present invention substantially depart from the conventional concepts and designs of the prior art, and in doing so provide an apparatus primarily developed for the purpose of removing lids from containers by positioning the apparatus on the lid and forcing the handle forward utilizing the user's body weight.

Therefore, it can be appreciated that there exists a continuing need for new and improved lid removing devices which can be used for removing lids from containers by positioning the apparatus on the lid and forcing the handle forward utilizing the user's body weight. In this regard, the present invention substantially fulfills this need.

SUMMARY OF THE INVENTION

In view of the foregoing disadvantages inherent in the known types of lid and can openers now present in the prior art, the present invention provides improved lid removing devices. As such, the general purpose of the present invention, which will be described subsequently in greater detail, is to provide a new and improved lid removing device and method which has all the advantages of the prior art and none of the disadvantages.

To attain this, the present invention essentially comprises a new and improved lid removing device comprising a vertically positioned front leg. The front leg is formed as a solid generally rectangular shaped block with an upper end and a lower end. The lower end of the front segment includes a generally semi-spherical shaped suction cup affixed thereto. The cup is adapted to be positioned on the central portion of a lid to provide a stable gripping point for the apparatus. A vertically positioned rear leg is formed as a solid generally rectangular shaped block with an upper end and a lower end. The rear leg is slightly longer than the front leg and includes a short frontwardly extending horizontal member at its lower end. The end of the member is formed in a downwardly angled configuration. The member is adapted to be positioned beneath the edge of a lid when utilizing the apparatus. A horizontally positioned central segment is formed as a solid generally rectangular shaped block with an upper surface, a lower surface, a front end and a rear end. The central segment is formed contiguous with, and positioned upon the upper ends of the front and rear legs. The front leg, rear leg and central segment form the components of a clamps adapted to be positioned on a lid to be opened. A handle is formed as a solid generally rectangular shaped block with an upper region and a lower region. The lower region is formed as a solid generally rectangular shaped block. The lowermost extent of the lower region is formed in an angled configuration. The lowermost extent is affixed to the upper surface of the central segment between its midpoint and rear end. The plane of the lower region is slanted upward and in the direction of the front leg, and forms an angle between about thirty and sixty degrees with respect to the central segment. The upper region is contiguous with the middle region and formed as a solid generally rectangular shaped block with a flat upper surface and a lower surface which includes a plurality of concave grooves. The uppermost extent of the handle extends a short distance beyond the front leg. When in the operative orientation, the handle is adapted to enable a user to remove a lid from a container by pushing the handle forward with his hand. A ball is formed in a generally spherical configuration. The ball is affixed to the uppermost extent of the handle. The ball is adapted to prevent a user's hand from slipping off the handle when utilizing the apparatus.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved lid removing devices which have all the advantages of the prior art lid and can openers and none of the disadvantages.

It is another object of the present invention to provide new and improved lid removing devices which may be easily and efficiently manufactured and marketed.

It is further object of the present invention to provide new and improved lid removing devices which are of durable and reliable constructions.

An even further object of the present invention is to provide new and improved lid removing devices which are susceptible of a low cost of manufacture with regard to both materials and labor, and which accordingly are then susceptible of low prices of sale to the consuming public, thereby making such lid removing devices economically available to the buying public.

Still yet another object of the present invention is to provide new and improved lid removing devices which provide in the apparatuses and methods of the prior art some of the advantages thereof, while simultaneously overcoming some of the disadvantages normally associated therewith.

Still another object of the present invention is to remove lids from containers by positioning the apparatus on the lid and forcing the handle forward utilizing the user's body weight.

Lastly, it is an object of the present invention to provide a lid removing device comprising a clamp consisting of a front leg, a rear leg and a central segment therebetween. A vertically positioned front leg is formed as a solid generally rectangular shaped block. A rear leg is formed as a solid generally rectangular shaped block. The lowermost extent of the rear leg includes a frontwardly extending horizontal member with a slanted end. A horizontally positioned central segment is formed as a solid generally rectangular shaped block. The central segment is positioned upon the uppermost extents of the front and rear segments. A handle is formed as a solid generally rectangular shaped block with an upper region and a lower region. The lower region is formed as a solid generally rectangular shaped block with an angled end at its lowermost extent. The lowermost extent is affixed to the central segment in an angled orientation in a direction opposite from the legs. The upper region is formed as a solid generally rectangular shaped block and includes a plurality of concave grooves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
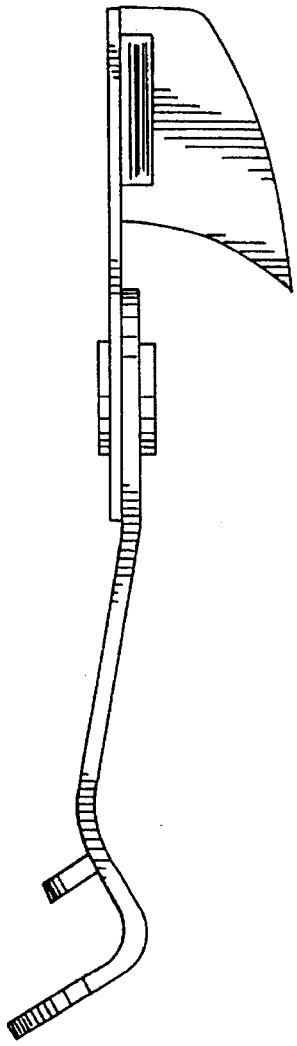
PRIOR ART FIG. 1
FIGS. 1 and 2 illustrate examples of prior art lid and can openers.

With reference now to the drawings, and in particular to FIG. 1 thereof, the preferred embodiment of the new and improved lid removing devices embodying the principles and concepts of the present invention and generally designated by the reference numeral 10 will be described.

Specifically, it will be noted in FIGS. 3 through 7, that there is provided a new and improved lid removing device. The lid removing device 10, in its broadest context, comprises a front leg 12, a rear leg 16, a central segment 20, a handle 30 and a ball 40.

More specifically, the vertically positioned front leg 12 is formed as a solid generally rectangular shaped block with an upper end and a lower end. The lower end of the front segment 12 includes a generally semi-spherical shaped suction cup 14 affixed thereto. The cup 14 is adapted to be positioned on the central portion of a lid to provide a stable gripping point for the apparatus. The cup is comprised of flexible materials. When force is applied to the front leg, the cup flattens out and sticks to the surface of the lid. The flexible composition of the cup prevents scratching of the surface of the lid. Note FIG. 3.

The second component of the apparatus is a vertically positioned rear leg 16 which is formed as a solid generally rectangular shaped block with an upper end and a lower end. The rear leg 16 is slightly longer than the front leg 12 and includes a short frontwardly extending horizontal member 18 at its lower end. The slightly longer length of the rear leg permits removal of lids of varying thicknesses. The end of the member 18 is formed in a downwardly angled configuration. The member 18 is adapted to be positioned beneath the edge of a lid when utilizing the apparatus. The angled configuration of the member facilitates the process of sliding it under the edge of a lid to be opened. See FIGS. 3 and 5.

The third component of the apparatus is a horizontally positioned central segment 20 which is formed as a solid generally rectangular shaped block with an upper surface 22, a lower surface 24, a front end 26 and a rear end 28. The central segment 20 is formed contiguous with, and positioned upon the upper ends of the front 12 and rear 16 legs. The central segment measures approximately twice the length of the front leg. Note FIGS. 5 and 6.

The front leg 12, rear leg 16 and central segment 20 form the components of a clamp adapted to be positioned on a lid to be opened. The clamp may be comprised of aluminum or sturdy plastic. It is adapted to withstand the considerable strains it will placed under during usage. Note FIG. 3.

The forth component of the apparatus is a handle 30 which is formed as a solid generally rectangular shaped block with an upper region and a lower region. The lower region is formed as a solid generally rectangular shaped block. The lowermost extent 32 of the lower region is formed in an angled configuration. The lowermost extent 32 is affixed to the upper surface 22 of the central segment between its midpoint and rear end 28. The lowermost extent is welded to the upper surface of the central segment add strength to the apparatus. Note FIG. 3.

The plane of the lower region is slanted upward and in the direction of the front leg 12, and forms an angle between about thirty and sixty degrees with respect to the central segment 20. The angle of the handle helps provides leverage for the user. The upper region is contiguous with the middle region and formed as a solid generally rectangular shaped block with a flat upper surface and a lower surface which includes a plurality of concave grooves 34. The user can firmly and comfortably grip the handle by placing his fingers within the grooves. The uppermost extent of the handle 30 extends a short distance beyond the front leg 12. Note FIGS. 3 and 5.

When in the operative orientation, the handle 30 is adapted to enable a user to remove a lid from a container by pushing the handle 30 forward with his hand. When using the apparatus, the user firmly grips the handle and leans forward pushing the handle downward in the direction of the front leg. The user utilizes his body weight while pushing forward. The forward motion causes the rear leg to move vertically thereby removing the lid from the container. Note FIG. 3.

Figure 2:
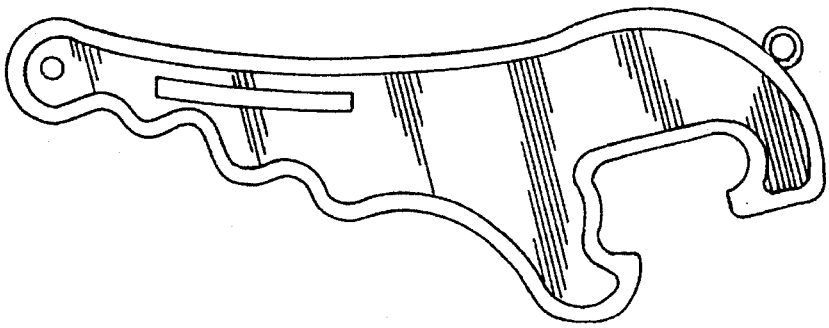
PRIOR ART FIG. 2
Figure 3:
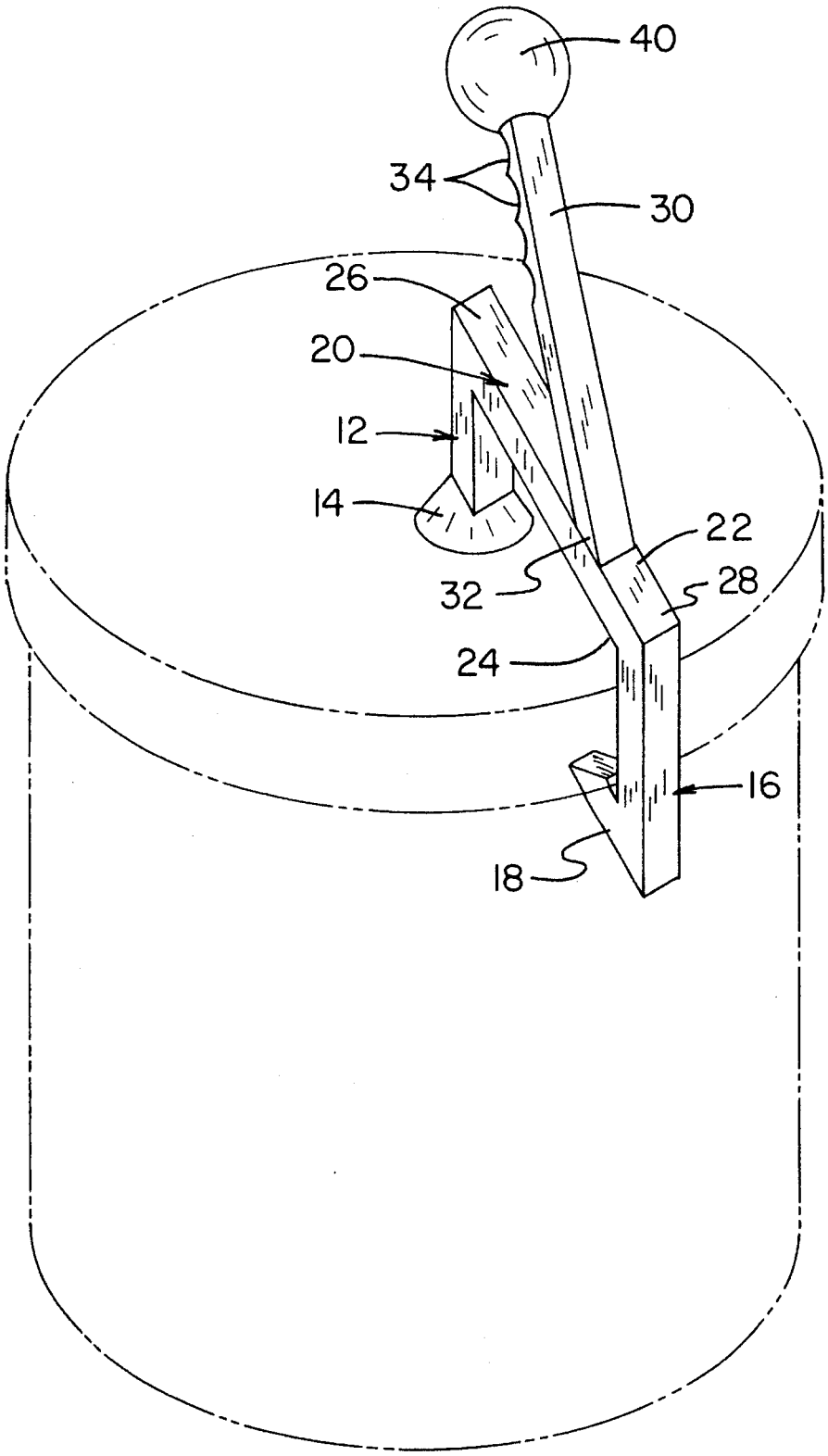
FIG. 3 is a perspective view of the preferred embodiment of the lid removing device constructed in accordance with the principles of the present invention.
Figure 4:
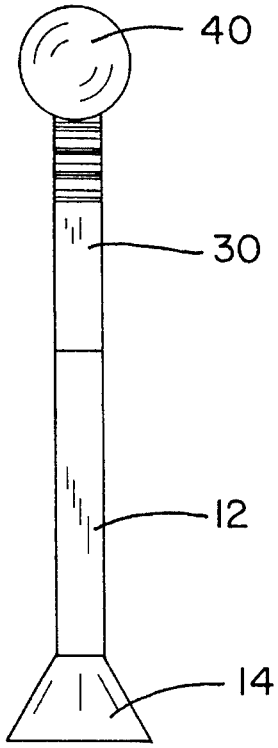
FIG. 4 is a front plan view of the lid removing device.
Figure 5:
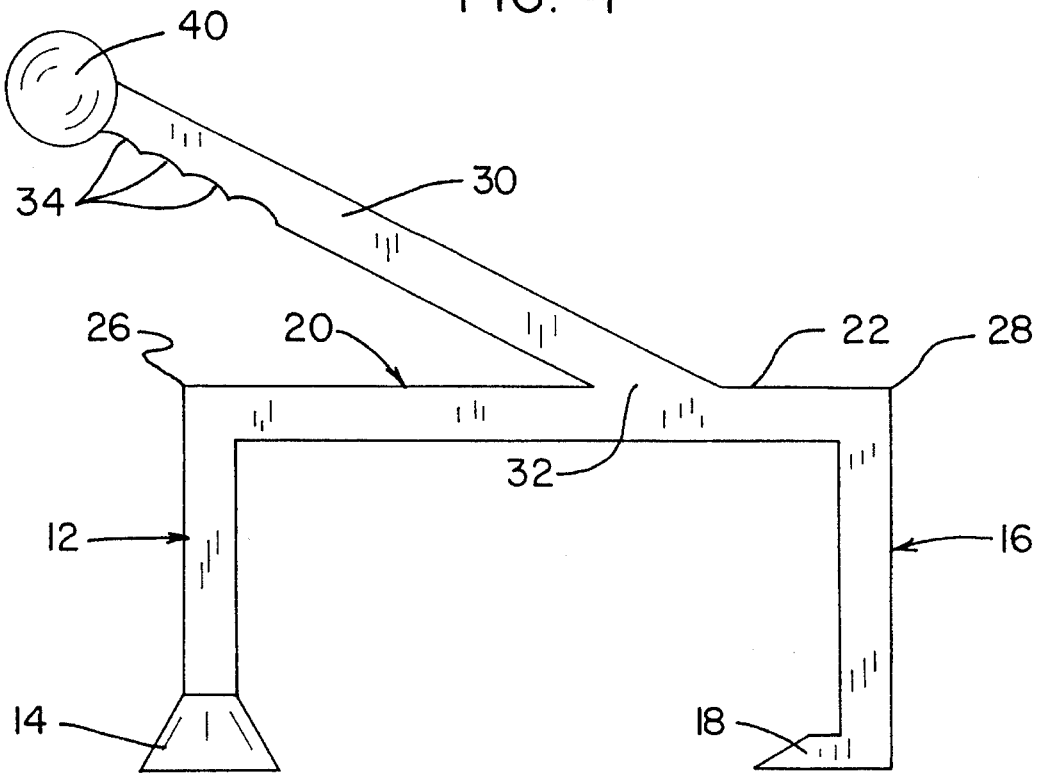
FIG. 5 is a side plan view of the lid removing device.
Figure 6:
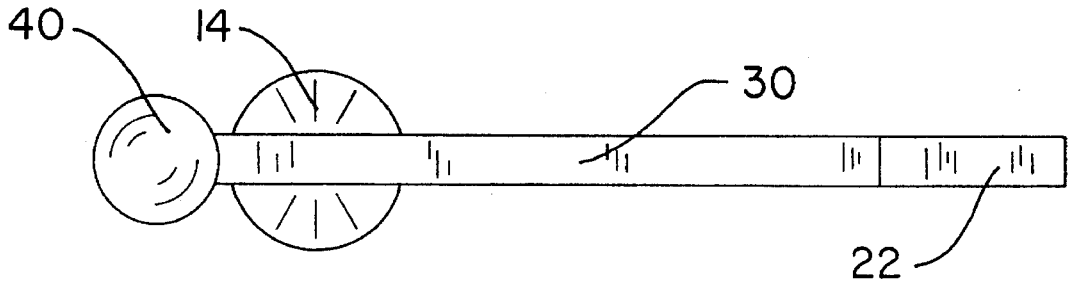
FIG. 6 is a top plan view of the lid removing device illustrating the position of the spherical ball.
Figure 7:
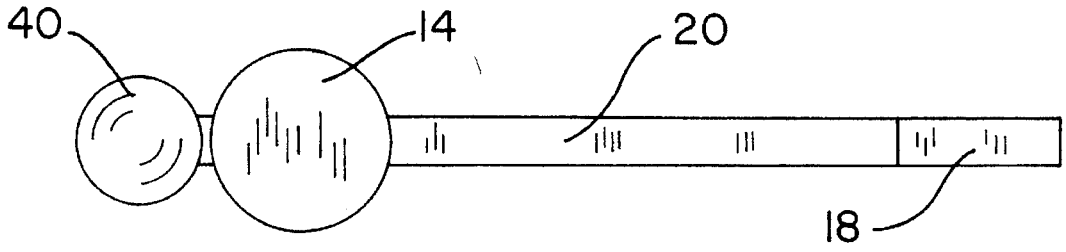
FIG. 7 is a bottom plan view of the lid removing device.

The fifth component of the apparatus is a ball 40 which is formed in a generally spherical configuration. The ball 40 is affixed to the uppermost extent of the handle 30. The ball 40 is adapted to prevent a user's hand from slipping off the handle 30 when utilizing the apparatus. The ball is welded to the uppermost extent of the handle to prevent dislodgement during use. Note FIGS. 2, 4 and 6.

Many items packaged for use by retail businesses, such as bakeries, delis, and cleaning services, come in large plastic containers with snap on lids. These lids can be difficult to remove, especially since the size of the container is so large that the user cannot pick it up to stabilize it. Often the user ends up following the container as it slides around the floor, or in an uncomfortable stooped position which may result in back injury. The lid removing device is the perfect solution to this problem.

The apparatus is a tool designed to use the body's weight to remove lids from bulky plastic containers. It may be made from sturdy, heavy duty plastic or lightweight aluminum. It has two major sections, a handle and a clamp. The clamp portion is shaped an inverted U configuration. The front leg of the U has a suction cup mounted at its bottom. This configuration adds stability and leverage to the opener. The bottom of the rear leg includes an angled horizontally projecting member at the bottom. It bends in at a right angle to itself and toward the other leg. It hooks under the lip of the lid. The handle is attached to the top of the U near the hook side, and at an angle so that the end of the handle points away from the hooked side. The handle has finger grips and a round ball at the top to provide stability and keep the user's hand from sliding off the handle.

The apparatus is simple to use. Slide the projecting member of the rear leg under the lid lip, rest the other leg on the lid, and using the weight of the body, press the handle down toward the lid. With the lid removing device the user will always be able to open lids on large plastic containers with minimum mess and time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved lid removing device comprising, in combination:

a vertically positioned front leg, the front leg being formed as a solid generally rectangular shaped block with an upper end and a lower end, the lower end of the front segment including a generally semi-spherical shaped suction cup affixed thereto, the cup adapted to be being positioned on the central portion of a lid to provide a stable gripping point for the apparatus;

a vertically positioned rear leg formed as a solid generally rectangular shaped block with an upper end and a lower end, the rear leg being slightly longer than the front leg and including a short frontwardly extending horizontal member at its lower end, the end of the member being formed in a downwardly angled configuration, the member adapted to be positioned beneath the edge of a lid when utilizing the apparatus;

a horizontally positioned central segment formed as a solid generally rectangular shaped block with an upper surface, a lower surface, a front end and a rear end, the central segment being formed contiguous with, and positioned upon the upper ends of the front and rear legs;

the front leg, rear leg and central segment forming the components of a clamp adapted to be positioned on a lid to be opened;

a handle formed as a solid generally rectangular shaped block with an upper region and a lower region, the lower region formed as a solid generally rectangular shaped block, the lowermost extent of the lower region being formed in an angled configuration, the lowermost extent being affixed to the upper surface of the central segment between its midpoint and rear end, the plane of the lower region being slanted upward and in the direction of the front leg and forming an angle between about thirty and sixty degrees with respect to the central segment, the upper region being contiguous with the middle region and formed as a solid generally rectangular shaped block with a flat upper surface and a lower surface including a plurality of concave grooves, the uppermost extent of the handle extending a short distance beyond the front leg, when in the operative orientation, the handle being adapted to enable a user to remove a lid from a container by pushing the handle forward with his hand; and a ball formed in a generally spherical configuration, the ball being affixed to the uppermost extent of the handle, the ball adapted to prevent a user's hand from slipping off the handle when utilizing the apparatus.

2. A lid removing device comprising, in combination:

a clamp consisting of a front leg and a rear leg, the front and rear legs being positioned vertically and formed as solid generally rectangular shaped blocks, the lowermost extent of the front leg including a generally semispherical shaped suction cup, the cup adapted to be positioned on the central portion of a lid to provide a stable leverage point when using the apparatus, the lowermost extent of the rear leg including a frontwardly extending horizontal member with a slanted end, a horizontally positioned central segment formed as a solid generally rectangular shaped block, the central segment positioned upon the uppermost extents of the front and rear segments; and a handle formed as a solid generally rectangular shaped block with an upper region and a lower region, the lower region formed as a solid generally rectangular shaped block with an angled end at its lowermost extent, the lowermost extent being affixed to the central segment in an angled orientation in a direction opposite from the legs, the upper region formed as a solid generally rectangular shaped block and including a plurality of concave grooves.

3. The apparatus as set forth in claim 2 wherein a ball formed in a generally spherical configuration is affixed to the uppermost extent of the handle, the ball adapted to prevent a user's hand from slipping off the handle when utilizing the apparatus.

* * * * *